US006276253B1

(12) United States Patent
Sprenger et al.

(10) Patent No.: US 6,276,253 B1
(45) Date of Patent: Aug. 21, 2001

(54) CARTRIDGE CLIP

(75) Inventors: Markus Sprenger, Eschen; Roland Hasler, Vaduz, both of (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/470,012

(22) Filed: Dec. 22, 1999

(30) Foreign Application Priority Data

Dec. 22, 1998 (DE) ..... 198 59 320

(51) Int. Cl.[7] ..... F42B 39/08

(52) U.S. Cl. ..... 89/35.01; 89/33.01; 89/34; 42/49.01; 206/3; 224/931

(58) Field of Search ..... 89/33.01, 33.1, 89/34, 35.01; 42/49.01, 87, 88; 206/3; 224/931

(56) References Cited

U.S. PATENT DOCUMENTS 2,856,720 * 10/1958 Kunz ..... 42/87
3,318,245 * 5/1967 Ferri et al. ..... 42/87
4,056,062 * 11/1977 Walser et al. ..... 89/35.01
4,098,169 * 7/1978 Gawlick et al. ..... 89/35.01
5,036,746 * 8/1991 Ehmig et al. ..... 89/35.01
5,811,717 * 9/1998 Day et al. ..... 89/35.01

FOREIGN PATENT DOCUMENTS 4136932 5/1993 (DE) .

* cited by examiner

*Primary Examiner*—J. Woodrow Eldred
(74) *Attorney, Agent, or Firm*—Sidley Austin Brown & Wood, LLP

(57) ABSTRACT

A cartridge clip including a carrier member (1) and a plurality of propellant-containing cartridges arranged in the carrier member (1) with the carrier member (1) having at its first free end a taper (11) a width (B) of which decreases in a direction transverse to a longitudinal extent of the carrier member (1) and transverse to longitudinal axes of the cartridges (2), and at least one locking surface (7, 8) provided in a region between the taper (11) and a cartridge adjacent to the taper (11) and facing the taper (11).

5 Claims, 1 Drawing Sheet

CARTRIDGE CLIP

BACKGROUND OF THE INVENTOR

1. Field of the Invention

The present invention relates to a cartridge clip including a carrier member and a plurality of propellant-containing cartridges arranged in the carrier member, with the carrier member having, at its first free end, a taper a width of which decreases in a direction transverse to the longitudinal extent of the carrier member and transverse to the axes of the cartridges.

2. Description of the Prior Art

For driving nail-shaped fastening elements in hard constructional components, setting tools, which are driven by cartridges containing a powdery propellant, are used. The cartridges are supplied from a cartridge clip as disclosed in German Publication DE 41 36 932 A1. For low-density constructional components with a small wall thickness, it is particularly important, to supply a small amount of energy to the setting tool for each setting process. This is effected by using the so-called "weak" cartridges, e.g., cartridges containing small amounts of propellant. Because with a small amount a complete combustion of the propellant take place, the "weak" cartridges are used in setting tools the combustion chamber of which has a particular geometry which enables to obtain, upon ignition of a cartridge, a combustion pressure necessary for the combustion of the propellant.

In setting tools without combustion chambers having this particular geometry, a complete combustion of the propellant takes place only then when "intermediate" or "strong" cartridges, i.e., cartridges containing more propellant, are used. Such cartridges permit to obtain a sufficient combustion pressure in chambers not having this particular geometry. The use of "weak" cartridges in setting tools without the specific combustion geometry of the combustion chamber leads to accumulation of non-burned propellant and to rapid dirt accumulation in the setting tool.

Accordingly, an object of the present invention is to provide a cartridge clip which can be mounted only in setting tools having a specific geometry enabling driving of the setting tool with "weak" cartridges.

Another object of the present invention, it to provide a cartridge clip which can be used only in setting tools in which a complete combustion of the propellant is insured.

SUMMARY OF THE INVENTION

These and other objects of the present invention, which will become apparent hereinafter, are achieved by providing a cartridge clip of the type described above in which the carrier member has, at its first free end, a taper a width of which decreases in a direction transverse to a longitudinal extent of the carrier member and transverse to longitudinal axes of the cartridges, and at least one locking surface provided in a region between the taper and a cartridge located adjacent to the taper and facing the taper.

The locking surface, which is provided on the carrier member prevents the cartridge clip with "weak" cartridges from being inserted in a setting tool which does not have a combustion chamber geometry adapted to the propellant power of such cartridges.

In order to prevent the cartridge clip from being inserted in a cartridge channel provided in the setting tool for receiving the clip, the locking surface extends substantially transverse to the longitudinal extent of the clip over a portion of its width.

In order to provide for support of a cartridge clip outside of the cartridge channel, the locking surface is formed, preferably, by an end surface of a strip provided on one side of the carrier member.

Therefore, the cartridge clip can be inserted only in a cartridge channel which has an additional groove corresponding to the cross-section of the strip and extending over the entire length of the channel.

A high rigidity of the cartridge clip is advantageously achieved by providing a strip which extends at least along a portion of the entire length of the carrier member.

To prevent the cartridge clip, upon the clip's being inserted in the cartridge channel, from tilting when it abuts, e.g., a stop which projects into the channel, the carrier member advantageously has two locking surfaces which, e.g., starting from both longitudinal edges of the carrier member, extend substantially transversed to the longitudinal extent of the cartridge clip over a portion of the width of the carrier member.

The carrier member of the cartridge clip can be provided with at least one locking surface which extends along a portion of the width of the carrier member, and/or a locking surface formed by an end surface of a strip provided on the carrier member.

The novel features of the present invention, which are considered as characteristic for the invention, are set forth in particular in the appended claims. The invention itself, however, both as to its construction and its mode of opration, together with additional advantages and objects thereof, will be best understood from the following detailed description of preferred embodiments when read with reference to the accompanying drawings.

DETAILED DESCRIPTION OT THE PREFERRED EMBODIMENT

Figure 1:
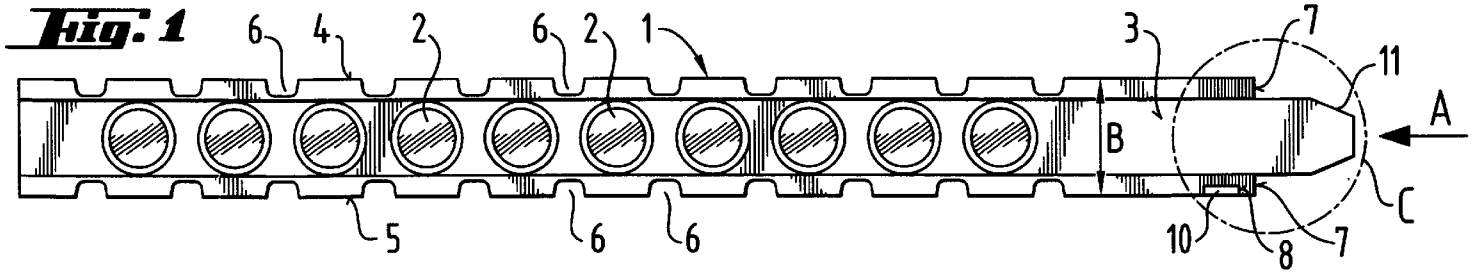
FIG. 1. shows a front view of a cartridge clip according to the present invention.
Figure 2:
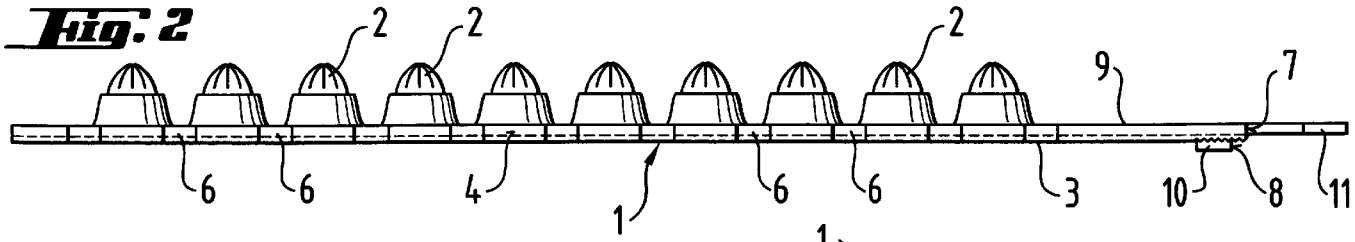
FIG. 2. shows a side view of the cartridge clip shown in FIG. 1.
Figure 4:
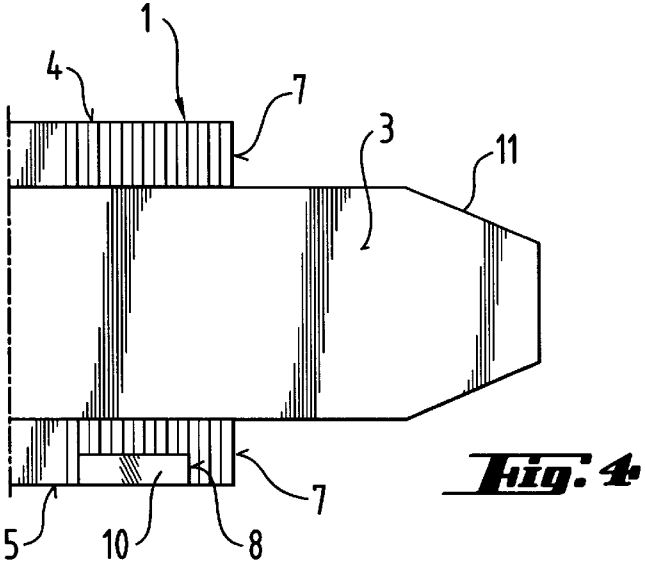
FIG. 4. shows a partial view at an increased scale of the cartridge clip shown in FIG. 1.
Figure 3:
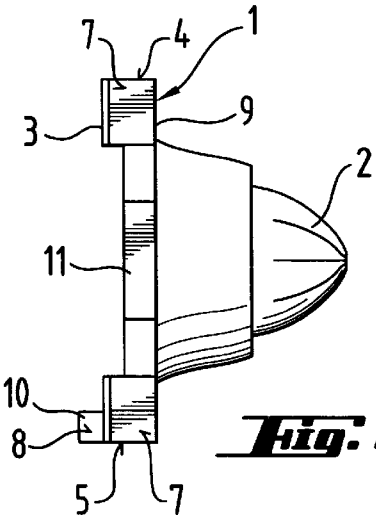
FIG. 3 shows a view of the cartridge clip shown in FIG. 1 in the direction of arrow "A"

A cartridge clip according to the present invention, which is shown in FIGS. 1–4, includes a strip-shaped carrier member 1 and a plurality of cartridges 2 which are filled with a powdery propellant and are arranged in the carrier member 1.

The carrier member 1 has two opposite longitudinal edges 4, 5 provided with a plurality of recesses 6. The recesses 6 are equidistantly spaced from each other and form lockingly cooperate, during the displacement of the cartridge clip in a catridge channel in a setting tool (not shown), with a displacement mechanism of the setting tool.

Separate cartridges 2 are likewise equidistantly spased. Each cartridge 2 extends through a correspondingly formed ore provided in the carrier member 1, with the longitudinal axis of the cartridge 2 extending substantially transverse to the longitudinal extent of the carrier member 1. The end surface of each cartridge 2, which is formed by the cartridge bottom, lies in a plane formed by a first side 3 of the carrier member 1. The cartridges project beyond a second side 9 of the carrier member 1, which lies opposite the first side 3. The distance between the adjacent recesses 6 corresponds to the distance between adjacent cartridges.

The carrier member 1 has, in a direction transverse to its longitudinal extent and transverse to the longitudinal axes of the cartridges, a width B which decreases in the region of a taper 11 at the first free end of the carrier member 2. A second free end of the carrier member 1 is formed by an end side of the carrier member 1 which extends parallel to the width B.

Between the taper 11 at the first free end of the carrier member 1 and the adjacent cartridge 2, the carrier member 1 has two locking surfaces 7 which extend from the longitudinal edges 4, 5 over a portion of the width B and substantially parallel to the width B. The locking surfaces 7 prevent the displacement of the cartridge clip in a setting tool (not shown), in the cartridge channel of which, e.g., a holding device for a cartridge clip projects from a side of the cartridge channel. The locking surfaces, which extend substantially transverse to the longitudinal extent of the carrier member 1, prevent the holding device from sidewise displacement out of the inner space of the cartridge channel.

A further locking surface 8 is likewise provided between the taper 11 of the carrier member 1 and the adjacent cartridge 2. The locking surface 8 is formed by an end surface of a strip 10 facing toward the free end of the taper 11. The strip 10 is provided on the first side 3 of the carrier member 1 and extends along a portion of the longitudinal extend of the carrier member. The locking surface 8 prevents displacement of the cartridge clip in a setting tool (not shown) which has a cartridge channel the inner dimension of which corresponds to the cross-section of the cartridge clip without the strip 10. Thus, the cartridge clip according to the present invention can be used in a setting to 1 having a cartridge channel the dimension of which match those of the cartridge clip.

Though the present invention has been shown and described with reference to a preferred embodiment, such is merely illustrative of the present invention and is not to be construed as a limitaiton thereof, and the present invention includes all modifications, variations and/or alternate embodiments within the spirit and scope of the present invention as defined by the appended claims.

What is claimed is:

1. A cartridge clip, comprising a carrier member (1); and a plurality of propellant-containing cartridges arranged in the carrier member (1), wherein the carrier member (1) has, at a first free end threof, a taper (11) a width (B) of which decreases in a direction transverse to a longtitudinal extent of the carrier member (1) and transverse to longitudinal axes of the cartridges (2), and at least one locking surface (7, 8) provided in a region between the taper 11) and a cartridge adjacent to the taper (11) and facing the taper (11).

2. A cartridge clip according to claim 1, wherein the at least one locking surface (7, 8) extends substantially transverse to the longitudinal extent of the carrier member (1) over a portion of the width (B) of the carrier member (1).

3. A cartridge clip according to claim 1, wherein the at least one locking surface (8) is formed by an end surface of a strip (10) provided on a side (3) of the carrier member (1).

4. A cartridge clip according to claim 3, wherein the strip (10) extends at least along a portion of an entire length of the carrier member 91).

5. A cartridge clip according to claim 1, wherein the carrier member (1) has two locking surfaces (7, 8).

* * * * *